United States Patent [19]

Ferment et al.

[11] 4,017,493

[45] Apr. 12, 1977

[54] TEXTURED POLYURETHANE SURFACE

[75] Inventors: George R. Ferment, Randolph, N.J.; David B. Skinner, Allentown, Pa.

[73] Assignee: GAF Corporation, New York, N.Y.

[22] Filed: June 11, 1975

[21] Appl. No.: 585,796

[52] U.S. Cl. ..... 427/257; 427/379; 427/385 B

[51] Int. Cl.[2] ..... B05D 3/02; B05D 5/02; B05D 7/04

[58] Field of Search ..... 260/75 NP, 75 NT, 18 WF; 428/141, 152, 425; 427/257, 379, 385 B

[56] References Cited

UNITED STATES PATENTS

| | | | |
|---|---|---|---|
| 2,981,712 | 4/1961 | Harper | 260/75 NP |
| 2,998,403 | 8/1961 | Müller | 260/75 NP |
| 3,316,189 | 4/1967 | Adams | 427/385 B |
| 3,345,234 | 10/1967 | Jecker et al. | 428/425 |
| 3,428,609 | 2/1969 | Chilvers et al. | 260/75 NP |
| 3,436,361 | 4/1969 | Wooster | 260/75 NP |
| 3,499,783 | 3/1970 | Nelson et al. | 428/425 |
| 3,645,943 | 2/1972 | Kvawczyk | 260/18 WF |
| 3,667,982 | 6/1972 | Bukalders | 427/257 |
| 3,692,557 | 9/1972 | Sormani | 427/257 |
| 3,705,132 | 12/1972 | Cuscurida | 260/75 NP |
| 3,779,793 | 12/1973 | Hughes et al. | 427/379 |
| 3,794,548 | 2/1974 | Wirth et al. | 428/425 |
| 3,804,810 | 4/1974 | Fryd | 428/425 |
| 3,925,582 | 12/1975 | Sample et al. | 427/379 |

OTHER PUBLICATIONS

Chemical Abstracts, vol. 82: 100360d, Jan. 1975.

*Primary Examiner*—James R. Hoffman
*Attorney, Agent, or Firm*—Walter C. Kehm; Joshua J. Ward

[57] ABSTRACT

A textured polyurethane surface is created from a vinyl substrate by first forming a smooth, uncured polyurethane coating on the substrate and then heating the thus coated substrate to a temperature between about 100° and about 160° C for 1 to 10 minutes followed by heating to temperatures of 170° to 210° C for 0.5 to 10 minutes. A textured surface may also be provided on a vinyl substrate having a previously cured polyurethane coating thereon by waiting at least about 1 week after the urethane coating has been cured and then heating the coated substrate to a temperature between about 140° C and about 210° C for 0.1 to 10 minutes. A preferred application is in the creation of textured surfaces on sheet vinyl floor and wall coverings coated with polyurethane.

9 Claims, No Drawings

TEXTURED POLYURETHANE SURFACE

BACKGROUND OF THE INVENTION

Vinyl coatings are used on a number of different types of products including such diverse items as wood panels, floor and wall coverings, etc. Various techniques have previously been used to impart textured characteristics to the surface of such materials. For instance, the surfaces of vinyl floor coverings have been textured by embossing either mechanically or chemically by methods well understood in the art.

Unfortunately, none of the prior art techniques for obtaining textured surfaces has proven entirely satisfactory. Mechanical embossing, for instance, does not easily achieve the fine texture which is sometimes desired because of a tendency for the entire surface to be crushed and because relatively minor variations in the pressure of the embossing rolls can result in substantial variations in the appearance of the final textured surface. Likewise, the various chemical techniques employed have failed in many cases to produce the desired appearance. The frequent tendency is for large areas of the surface to be affected and more precise results such as a sharp pebbled appearance have been difficult or impossible to obtain.

SUMMARY OF THE INVENTION

It is, accordingly, an object of the invention to provide a process for creating a textured surface on a polyurethane coated vinyl substrate.

In accordance with one embodiment of the invention, a textured surface is obtained on a vinyl substrate by first forming a smooth, uncured polyurethane coating on the vinyl substrate. The coated substrate is then heated to a temperature between about 100° and about 160° C for a time of at least about one minute, preferably for a time of between about 1 and about 10 minutes, and is then heated to a temperature between about 170° and about 210° C, for at least about 0.5 minute, preferably between about 0.5 and about 10 minutes. The vinyl substrate is preferably a fused polyvinyl chloride topcoat or wear layer on flexible sheet-type covering material and is preferably applied to the material not more than about 3 days prior to coating with the polyurethane.

In accordance with another embodiment of the invention, a vinyl substrate having a cured polyurethane coating adhered thereto is treated for texturing of the surface thereof by heating the coated substrate to a temperature between 140° and about 210° C for a time of at least about 0.1 minute, preferably between about 0.1 and about 10 minutes. In this embodiment of the invention it is essential that the cured polyurethane coating be formed on the vinyl substrate at least about one week prior to treatment as described herein for production of satisfactory texture on the surface of the polyurethane coated substrate.

DETAILED DESCRIPTION OF THE INVENTION

The invention is broadly applicable to the creation of textured polyurethane surfaces on vinyl substrates and is especially useful in creating textured polyurethane surfaces on vinyl coatings, especially polyvinyl chloride coatings used as topcoats or wear layers for sheet-type covering materials frequently used on walls and floors. The vinyl substrate may itself be a coating or may be the surface of a piece of solid vinyl material, etc. While the textured surfaces created by the present invention are frequently used in connection with floor and wall coverings, it is understood that other applications are suitable and that the process of the invention is broadly applicable to any situation in which a textured surface is desired on a polyurethane coating adhered to a vinyl surface.

As mentioned, the vinyl substrate used in practicing the invention is preferably polyvinyl chloride (PVC) of the type generally used as wear layers on sheet covering materials. In the preferred embodiment where the vinyl substrate is PVC coating or wear layer on tile, sheet covering material, etc., the PVC preferably takes the form of a cured PVC plastisol or organosol. Such PVC plastic may be any of the various PVC resin materials normally used in connection with coating of decorative sheet materials and may specifically include but is not limited to those described in U.S. Pat. No. 3,458,337, the disclosure of which is incorporated herein by reference. Where the vinyl substrate is in the form of a coating, it is preferred that the vinyl coating on which polyurethane coating is applied in accordance with the invention have a minimum thickness of about 0.125 mm.

The polyurethane coating used in accordance with the invention may be any suitable polyurethane but, where a clear coating is desired, is preferably a cycloaliphatic or aliphatic type polyurethane of the moisture-cure type. Aromatic urethanes have a strong tendency toward discoloration and are therefore generally not preferred for use in connection with clear coatings. Suitable polyurethanes may be prepared in a conventional manner such as by reacting hydroxylated polymers with organic polyisocyanates in the manner well known in the art. Suitable organic polyisocyanates include, for instance, ethylene diisocyanate; ethylidene diisocyanate; propylene-1,2-diisocyanate; cyclohexylene-1,2-diisocyanate; m-phenylene diisocyanate; 2,4-toluene diisocyanate; 2,6-toluene diisocyanate; 3,3'-dimethyl-4,4'-biphenylene diisocyanate; p,p',p''-triphenylmethane triisoene diisocyanate; 3,3'-diphenyl-4,4'-biphenylene diisocyanate; 4,4'-biphenylene diisocyanate; 3,3'-dichloro-4,4'-biphenylene diisocyanate; p,p',p''-triphenylmethane triisocyanate; 1,5-nepthalene diisocyanate; furfurylidene diisocyanate or polyisocyanates, in a blocked or inactive form such as the bis-phenyl carbamates of 2,4- or 2,6-toluene diisocyanate; p,p'-diphenyl methane diisocyanate; p-phenylene diisocyanate; 1,5-napthalene diisocyanate and the like. It is preferred to use a commercially available mixture of toluene diisocyanates which contains 80 percent 2,4-toluene diisocyanate and 20 percent 2,6-toluene diisocyanate or 4,4'-diphenylmethane diisocyanate.

Polyurethanes applied as coatings in accordance with the invention may, of course, be in the form of solutions in suitable solvents such as xylene, toluene, etc.

Materials for the polyurethane coatings may be supplied in 1 package or 2 package prepolymer systems or oil modified systems, etc. all in the manner well known in the industry. Such materials are described for instance in the pamphlet "Urethane Coatings", published by the Federation of Societies for Paint Technology (1970). Radiation-curable urethane coatings may also of course be used.

In a preferred embodiment of the invention the textured polyurethane surface is created on conventional sheet-type wall or floor covering material having a fused PVC wear layer. The manufacture of such covering materials is well known in the art. Such material frequently has a suitable backing such as felt on which are coated various layers of sealer, plastisols, pigmented layers, etc. Also, in accordance with known technology, layers of foamed plastic may be used on either side of the felt backing material in the manner well known to those skilled in the art.

The preferred fused PVC wear layer referred to above is preferably at least about 0.125 mm thick and may frequently have a thickness substantially greater such as up to about 0.5 mm or more. Such a wear layer may comprise any of the PVC plastisol or organosol materials usual for such applications such as those described in the above-mentioned U.S. Pat. No. 3,458,337. In practicing the invention it is found that the molecular weight of the PVC has an effect upon the type of texture obtained from the polyurethane coating. Generally speaking, the relatively lower molecular weight PVC materials, when used as substrates in combination with polyurethane coatings in accordance with the invention, result in relatively finer surface texture.

In the preferred embodiment of the invention in which vinyl substrates such as conventional sheet vinyl floor or wall coverings are manufactured with a conventional cured polyurethane coating and subsequently treated in accordance with the invention, it is essential that a sufficient period of time, preferably at least about one week and more usually at least about two weeks be allowed to lapse between the curing of the urethane coating and the treatment in accordance with the invention to create or further enhance a textured finish on the coating. Previously cured urethane surfaces are heated to temperatures between about 140° and about 210° C in accordance with the invention and such treatment is preferably carried on for times between about 0.1 and about 10 minutes.

In the embodiment of the invention in which the texturing or wrinkling by the urethane coating is accomplished during initial curing of the coating, the coating is applied and initially heated to temperatures between about 100° and about 160° C, preferably for a period of time between about 1 and about 10 minutes, following which the material is heated to temperatures between about 170° and about 210° C, preferably for a time of between about 0.5 and about 10 minutes.

While thicknesses of the various layers or coatings involved are not considered critical to the invention, the urethane layer is preferably between about 0.025 and about 0.080 mm thick when cured. Where uncured urethane is coated onto the vinyl substrate in the form of a solution, the wet coating frequently forms a layer between about 0.05 and about 0.20 mm thick.

The process of the present invention is especially useful in connection with the creating of a textured surface on previously cured urethane which forms a wear layer on sheet vinyl flooring material. In many instances such material is originally formed as described above with a felt substrate, seal coat, one or more foamable plastisol layers, a printed layer and a PVC wear layer immediately under the polyurethane wear layer. Very frequently such material is subsequently further enhanced by the addition of a layer of foamable plastic such as foamable PVC plastisol or organosol on the reverse side of the felt substrate. When this is done the foam is usually cured by subjecting the entire product to temperatures sufficiently high to foam and fuse the foamable layer. By the application of the present invention it is possible to simultaneously foam and cure the foamable layer and create or further enhance a textured surface. This results in an extremely desirable form of sheet vinyl flooring material having foam backing and a textured polyurethane wear layer adhered to a PVC wear layer.

The following examples illustrate various possible embodiments of the invention but are not intended to limit the scope of the invention.

EXAMPLE I

In this example the base material or substrate may be a 0.813 mm thick sheet of asbestos felt onto which is doctored a latex size coating which acts as a barrier against plasticizer migration and improves adhesion of the vinyl foam layer. A foamable PVC coating 0.254 mm thick may then be applied to the latex coated felt using a knife coater and gelled in a forced air oven at 135° C.

This layer has the following composition:

| | Parts by Weight |
|---|---|
| PVC homopolymer dispersion resin (I.V.–0.81) | 50 |
| PVC homopolymer suspension resin (I.V.–0.73) | 50 |
| 2,2,4 Trimethyl pentanediol isobutyrate benzoate plasticizer | 54 |
| Epoxidized soya oil | 6 |
| Zinc catalyst | 2.5 |
| Azodicarbonamide | 2.5 |
| Titanium dioxide | 7.5 |

The gelled, smooth sheet is then printed with a design by conventional techniques after which a 0.254 mm thick clear PVC wear layer is applied. The wear layer has the following composition:

| | Parts by Weight |
|---|---|
| PVC homopolymer dispersion resin (I.V.–1.51) | 100 |
| 2,2,4 Trimethyl pentanediol isobutyrate benzoate plasticizer | 54 |
| Heat and light stabilizer | 5 |
| Epoxidized soya oil | 6 |
| Mineral spirits | 3 |
| Alkylphenylether of polyethylene glycol | 0.6 |

Following application of the wear layer, the entire sheet is subjected to a temperature of 180° C for 3 minutes to cure (fuse) the wear layer and to cure and foam the foamable layer.

This freshly prepared fused sheet is next (within one day) coated with a catalyzed xylene solution of a moisture cure urethane prepolymer which is a polyether-polyester blend based on 4,4′-methylenedicyclohexane diisocyanate and trimethylolpropane plus polypropylene glycol (ether) and adipic acid/ethylene glycol (ester).

The coated sheet is then heated in a forced air oven at 150° C for 2 minutes to evaporate the solvent, followed by a 2 minutes at 188° C to cure the polyurethane surface. The resultant product has a clear polyurethane surface finish about 0.05 mm thick and has, during the cure cycle, developed surface wrinkles, i.e. a textured surface. This wrinkle-texture has a height variation of about 0.1 to 0.3 mm between the hills and valleys of its surface.

EXAMPLE II

The cured polyurethane surfaced product of Example I is aged about 2 weeks at ambient conditions. After aging, the sheet is subjected to an additional heat treatment of 3 minutes at 171° C which further enhances the texture of the already wrinkled surface. The height variation now measures about 0.2 to 0.4 mm between the hills and valleys of its surface.

EXAMPLE III

The wet, urethane coated sheet from Example I is dried and cured at 150° C for 15 minutes. This cure cycle results in a cured polyurethane surfaced sheet which is flat, possessing virtually no surface wrinkles. This flat sheet is then aged about 6 weeks at ambient conditions and heat treated for about 3 minutes at 188° C to develop a textured or wrinkled surface.

EXAMPLE IV

The clear vinyl plastisol of Example I is made with a lower molecular weight (I.V. — 0.81) PVC homopolymer dispersion resin. The resulting surface wrinkles are much finer in texture and greater in number of wrinkles per unit area.

EXAMPLE V

The fused sheet of Example I is coated with a 2 mil thick coat of a UV curable urethane and cured for 6 seconds under medium pressure mercury lamps. The resultant flat sheet is aged several weeks at ambient conditions and heated at 177° C for 4 minutes to develop surface wrinkles.

EXAMPLE VI

The product of Example I is heated by infra-red heaters for 10 seconds to further enhance the surface texture.

EXAMPLE VII

An aged, flat sheet such as described in Example 3 is heated on chrome drum at 171° C for 3 minutes to develop surface wrinkles.

While the invention has been described above with respect to preferred embodiments thereof, it will be understood by those skilled in the art that various changes and modifications may be made without departing from the spirit or scope of the invention.

What we claim is:

1. A process for creating a textured surface with a polyurethane coating on a polyvinyl chloride substrate which comprises;

a. forming a smooth, uncured, polyurethane coating on a polyvinyl chloride substrate;

b. heating the polyurethane coated polyvinyl chloride substrate to a temperature between about 100° and 160° C for a time of between about 1 and about 10 minutes; and c. then heating said coated substrate to a temperature between about 170° and about 210° C for a time of between about 0.5 and about 10 minutes to thereby produce a cured, textured, polyurethane surface on said polyvinyl chloride substrate.

2. The process of claim 1 in which the polyvinyl chloride substrate has been formed less than about 3 days prior to coating with polyurethane.

3. The process of claim 1 in which the polyvinyl chloride substrate is flexible sheet covering material having a fused polyvinyl chloride wear layer.

4. The process of claim 1 in which the polyurethane is an aliphatic or cycloaliphatic polyurethane of the moisture-cure type and is applied to the polyvinyl chloride substrate as a solution of such polyurethane in a solvent therefor.

5. The process of claim 4 in which the polyurethane is a polyether-polyester blend based on 4,4'-methylenedicyclohexane diisocyanate and trimethylolpropane plus polypropylene glycol ether and adipic acid/ethylene glycol ester catalyzed with tin catalyst.

6. A process for creating a textured polyurethane surface on a polyvinyl chloride substrate previously coated with a cured, polyurethane coating which comprises;

a. aging the coated polyvinyl chloride substrate at least about one week following curing of the polyurethane coating; and b. then heating the coated substrate to a temperature between about 140° and about 210° C for a time of between about 0.1 and about 10 minutes to thereby texture the surface of said polyurethane coated substrate.

7. The process of claim 6 in which the polyurethane coating comprises an aliphatic or cycloaliphatic polyurethane of the moisture-cure type.

8. The process of claim 6 in which the polyvinyl chloride substrate is flexible sheet-type covering material having a fused polyvinyl chloride wear layer.

9. The process of claim 6 in which the polyurethane coating is a polyether-polyester blend based on 4,4'-methylenedicyclohexane diisocyanate and trimethylol propane plus polypropylene glycol ether and adipic acid/ethylene glycol ester catalyzed with tin catalyst.

* * * * *